United States Patent [19]

Bull

[11] Patent Number: 4,935,065

[45] Date of Patent: Jun. 19, 1990

[54] PHOSPHATE-FREE ALKALINE DETERGENT FOR CLEANING-IN-PLACE OF FOOD PROCESSING EQUIPMENT

[75] Inventor: Sandra L. Bull, Eagan, Minn.

[73] Assignee: Ecolab Inc., St. Paul, Minn.

[21] Appl. No.: 131,235

[22] Filed: Dec. 7, 1987

Related U.S. Application Data

[63] Continuation of Ser. No. 899,776, Aug. 22, 1986, abandoned, which is a continuation of Ser. No. 728,569, Apr. 29, 1985, abandoned.

[51] Int. Cl.[5] ..... C11D 7/06; C11D 7/36; C11D 7/54; C23G 1/14

[52] U.S. Cl. ..... 134/22.13; 134/22.14; 134/22.17; 134/22.19; 134/40; 252/95; 252/103; 252/156; 252/174.16; 252/174.24; 252/180; 252/181; 252/DIG.11; 252/DIG. 17

[58] Field of Search ..... 134/22.13, 22.14, 22.17, 134/22.19, 40; 252/95, 103, 156, 174.16, 174.24, DIG. 11, DIG. 17, 180

[56] References Cited

U.S. PATENT DOCUMENTS

| | | | |
|---|---|---|---|
| Re. 28,553 | 9/1975 | von Freyhold | 252/175 |
| 3,297,578 | 1/1967 | Crutchfield | 252/99 |
| 3,453,144 | 7/1969 | Morgan | 134/26 |
| 3,591,509 | 7/1971 | Parks et al. | 252/137 |
| 3,671,440 | 6/1972 | Sabatelli et al. | 252/103 |
| 3,689,436 | 9/1972 | Stamm et al. | 252/545 |
| 3,706,634 | 12/1972 | Kowalski | 204/46 |
| 3,852,209 | 12/1974 | Hofmann | 252/95 |
| 3,886,204 | 5/1975 | Geffers | 252/94 |
| 3,886,205 | 5/1975 | Geffers | 252/94 |
| 3,923,876 | 12/1975 | Heins | 252/174.16 |
| 3,959,167 | 5/1976 | Hwa | 252/180 |
| 3,959,168 | 5/1976 | Germscheid | 252/180 |
| 3,965,024 | 6/1976 | Schmadel | 252/95 |
| 4,051,058 | 9/1977 | Bowing et al. | 252/186 |
| 4,102,799 | 7/1978 | Finck | 252/99 |
| 4,147,650 | 4/1979 | Sabatelli | 252/103 |
| 4,179,391 | 12/1979 | Kaufmann | 252/99 |
| 4,206,075 | 6/1980 | Boffardi | 252/389 A |
| 4,228,048 | 10/1980 | Tesdahl | 252/156 |
| 4,340,388 | 7/1982 | Kowalski | 8/584 |
| 4,361,492 | 11/1982 | Dubin | 252/175 |
| 4,430,243 | 2/1984 | Bragg | 252/91 |
| 4,432,879 | 2/1984 | Greaves | 252/180 |
| 4,469,569 | 9/1984 | Tomaszewski et al. | 204/52 R |
| 4,521,332 | 6/1985 | Milora | 252/527 |
| 4,539,144 | 9/1985 | de Ridder | 252/526 |
| 4,576,722 | 3/1986 | Gaylor | 252/180 |
| 4,579,676 | 4/1986 | Bull | 252/94 |
| 4,600,524 | 7/1986 | Cuisia | 252/181 |

FOREIGN PATENT DOCUMENTS

| | | | |
|---|---|---|---|
| 1117395 | 2/1982 | Canada | 252/180 |

OTHER PUBLICATIONS

Monsanto, Technical Bulletin, IC/SCS-313, "Deguest 2010 Organaophosphorus Product".

Monsanto, Technical Bulletin, IC/SCS-314 "Colling Water Corrosion Inhibition with Dequest Organophosphorus Compounds".

Monsanto, Technical Bulletin, IC/SCS-320, "Dequest 2000 and 2006 Phosphonates for Scale and Corrosion Control Chelation, Dispersion".

Monsanto, Technical Bulletin, IC/SCS-321, "Dequest 2041 and 2051 Phosphohates Multifunctional Metal Ion Control Agents".

Monsanto, Technical Bulletin, I-247, "Dequest Phosphorus-Based Compounds".

Mobay Chemical Corporation, Product Information "Bayhibit AM, Scale Inhibitor for Water Treatment".

*Primary Examiner*—Dennis Albrecht

*Attorney, Agent, or Firm*—Merchant, Gould, Smith, Edell Welter & Schmidt

[57] ABSTRACT

Aqueous alkaline cleaning concentrates and wash solutions are disclosed which comprise an alkali metal hydroxide, a water-conditioning acrylic polymer, an active chlorine source and a fatty or oily soil-dispersing amount of a low molecular weight aliphatic phosphonic acid containing at least two groups capable of forming anions under conditions of high pH, at least one of which is a phosphonic acid group. The wash solutions are particularly useful to clean cleaned-in-place food-processing equipment which has been fouled with greasy or oily soils.

3 Claims, No Drawings

PHOSPHATE-FREE ALKALINE DETERGENT FOR CLEANING-IN-PLACE OF FOOD PROCESSING EQUIPMENT

This application is a continuation of U.S. patent application Ser. No. 899,776 filed 8/22/86, which was a continuation of U.S. patent application Ser. No. 728,569 filed 4/29/85, both of which are now abandoned.

FIELD OF THE INVENTION

The present invention relates to aqueous alkaline compositions that can be used in household, industrial or institutional cleaning applications. More particularly, the compositions are most advantageously used for cleansing surfaces of lipid-containing soils.

BACKGROUND OF THE INVENTION

Meat, fish, or dairy products yield soils containing lipids such as oils and fats. These soils present special problems in detergent formulation and application, particularly when present on food storage, processing and preparation equipment. Alkali metal hydroxide solutions can degrade fats and oils by saponification reactions and are commonly employed in combination with water-conditioning condensed phosphates such as sodium tripolyphosphates, which also act to disperse or emulsify fatty soils. However, in recent years, the use of high concentrations of phosphate in detergents has come under increasing attack due to environmental concerns, and the permissible phosphate content of cleaning compositions has been severely limited by many states or municipalities, e.g., to no more than 0.5%.

Although water-soluble or dispersible polymers, such as those disclosed in U.S. Pat. No. 3,671,440, have been used to replace phosphate salts as water-conditioners, such polymers have not served as effective phosphate substitutes insofar as fat dispersal is concerned. Also, polyacrylic acids exhibit varying degrees of instability in chlorinated detergents and can substantially degrade the chlorine content of such compositions. Other dispersants such as organic solvents or synthetic surfactants can act to disperse or emulsify fatty oils, but often can exhibit unstability in highly alkaline cleaning systems at effective concentrations or can be toxic.

Therefore a need exists for aqueous highly-alkaline cleaning solutions which will both disperse and degrade deposits of fatty or oily soils on articles such as food-processing equipment or utensils, in the presence of substantial water hardness factors.

BRIEF DESCRIPTION OF THE INVENTION

The present invention is also directed to a method for cleaning articles fouled with fatty or oily soil comprising contacting a low-phosphorous aqueous composition or "wash solution" with the fouled article for a period of time effective to disperse the soil deposits.

The aqueous wash solution can be prepared from a water-dilutable aqueous concentrate comprising an alkali metal hydroxide, a source of active chlorine, a water-conditioning acrylic polymer and an organic phosphonic acid.

When diluted to about 0.2–5% with water the present concentrates afford wash solutions effective to cleanse articles fouled with fatty and/or greasy soils, such as those comprising lard, tallow, butterfat, fish oil and the like. Such wash solutions are particularly useful when employed in recirculating cleaned-in-place systems, but may also be used to form soaking baths or in systems designed for surface application.

DETAILED DESCRIPTION OF THE INVENTION

The aqueous cleaning compositions of the invention are preferably prepared as concentrated solutions which can be diluted to the desired concentration with water at the end-use locus. These concentrates are prepared by forming a mixture of the various components with a major proportion of water, preferably in soft water having a hardness of no more than about 1–2 grains of hardness/gallon (0.015–0.035 g/l).

The present concentrates will comprise an amount of an alkali metal hydroxide, preferably sodium hydroxide, potassium hydroxide or mixtures thereof, effective to degrade the greasy soils commonly encountered in the food-processing industry. The sodium or potassium hydroxide can be employed in either the liquid (about a 10–60% aqueous solution) or in the solid (powdered or pellet form). The preferred form is commercially-available sodium hydroxide, which can be obtained in aqueous solution at a concentration of about 50 wt-% and in a variety of solid forms of varying particle sizes.

The alkaline cleaning compositions of this invention can also contain a source of available chlorine which acts as a biocidal or destaining agent. Both organic and inorganic sources of available chlorine are useful, including alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate dihydrate, 1,3-dichloro-5,5-dimethylhydantoin, N-chlorosulfamide, Chloramine T, Dichloramine T, Chloramine B and Dichloramine B. The preferred class of sources of available chlorine comprise inorganic chlorine sources such as sodium hypochlorite, monobasic calcium hypochlorite, dibasic calcium hypochlorite, monobasic magnesium hypochlorite, dibasic magnesium hypochlorite, and mixtures thereof. The most preferred sources of available chlorine include sodium hypochlorite and mono- and dibasic calcium hypochlorite, for reasons of availability, stability and highly effective disinfectant action.

The present compositions can also incorporate a water soluble acrylic polymer which can act to condition the wash solutions under end-use conditions. Such polymers include polyacrylic acid, polymethacrylic acid, acrylic acid-methacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolyzed acrylonitrilemethacrylonitrile copolymers, or mixtures thereof. Water-soluble salts or partial salts of these polymers such as the respective alkali metal (e.g. sodium, potassium) or ammonium salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 6,000. These polymers are commercially available, and methods for their preparation are well-known in the art.

For example, commercially-available water-conditioning polyacrylate solutions useful in the present cleaning solutions include the sodium polyacrylate solution, Colloid® 207 (Colloids, Inc., Newark, N.J.); the polyacrylic acid solution, Aquatreat® AR-602-A (Alco Chemical Corp., Chattanooga, Tenn.); the polyacrylic acid solutions (50–65% solids) and the sodium polyacrylate powders (m.w. 2,100 and 6,000) and solutions (45% solids) available as the Goodrite® K-700 series from B. F. Goodrich Co.; and the sodium- or partial sodium salts of polyacrylic acid solutions (m.w. 1000–4500) available as the Acrysol® series from Rohm and Haas.

The present cleaning solutions will also comprise an effective grease-dispersing amount of a water-soluble organic phosphonic acid. Preferred phosphonic acids include low molecular weight compounds containing at least two anion-forming groups, at least one of which is a phosphonic acid group. Such useful phosphonic acids include mono-, di-, tri- and tetra- phosphonic acids which can also contain groups capable of forming anions under alkaline conditions such as carboxy, hydroxy, thio and the like. Among these are phosphonic acids having the formulae:

$$R_1N[CH_2PO_3H_2]_2 \text{ or } R_2C(PO_3H_2)_2OH$$

wherein $R_1$ may be -[(lower)alkylene]$N[CH_2PO_3H_2]_2$ or a third $CH_2PO_3H_2$ moiety; and wherein $R_2$ is selected from the group consisting of $C_1$–$C_6$ alkyl.

The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid.

Preferred organic phosphonic acids include 1-hydroxyethylidene-1,1-diphosphonic acid ($CH_3C(PO_3H_2)_2OH$), available from Monsanto Industrial Chemicals Co., St. Louis, Mo. as Dequest® 2010, a 58–62% aqueous solution; amino [tri(methylenephosphonic acid)] ($N[CH_2PO_3H_2]_3$), available from Monsanto as Dequest® 2000, a 50% aqueous solution; ethylenediamine [tetra(methylene-phosphonic acid)] available from Monsanto as Dequest® 2041, a 90% solid acid product; and 2-phosphonobutane-1,2,4-tricarboxylic acid available from Mobay Chemical Corporation, Inorganic Chemicals Division, Pittsburgh, Pa. as Bayhibit AM, a 45–50% aqueous solution. It will be appreciated that, the above-mentioned phosphonic acids can also be used in the form of water-soluble acid salts, particularly the alkali metal salts, such as sodium or potassium; the ammonium salts or the alkylol amine salts where the alkylol has 2 to 3 carbon atoms, such as mono-, di-, or tri- ethanolamine salts. If desired, mixtures of the individual phosphonic acids or their acid salts can also be used. Further useful phosphonic acids are disclosed in U.S. Pat. No. 4,051,058, the disclosure of which is incorporated by reference herein. Of the phosphonic acids useful in the present invention, those which do not contain amino groups are especially preferred, since they produce substantially less degradation of the active chlorine source than do phosphonic acids comprising amino groups.

A number of organic phosphonic acids have been disclosed to be useful as water-conditioning and as process water deposit control additives to control inorganic mineral scales. Further, the organic phosphonic acids disclosed in U.S. Pat. No. 4,051,058 have been disclosed to be useful to stabilize hydrogen peroxide solutions which also can include microbiocidal agents. Although organic phosphonic acids have been disclosed to be useful for the above-stated purposes, it has surprisingly been discovered that when used as additives to the present alkaline, polyacrylics-containing cleaners, such polyfunctional phosphonic acids are highly effective to disperse natural or synthetic fats and oils such as lard, tallow, butterfat, fish oils, vegetable oils and the like. Furthermore, these phosphonic acids are highly stable in the presence of active chlorine and alkali.

Since the phosphorous content of these substances is much lower than the phosphorous content of the inorganic condensed phosphate salts such as sodium tripolyphosphate, organic phosphonic acids can be used in relatively large amounts, if necessary, without exceeding the phosphate limits imposed on effluent discharges. Thus, the organic phosphonic acid can be employed in the dilutable concentrates in amounts at which the concentrates will generally be considered to be "low phosphorous," "low phosphate" or "phosphate-free", e.g. which comprise less than about 0.5% phosphate.

For some cleaning operations, such as soak or surface applications, it may be desirable to add minor but effective amounts of alkali-stable synthetic organic surfactants, which may be selected from any of the known surfactant classes which are water miscible and chemically-compatible. Preferred for use in the present systems are the anionic and nonionic surfactants, including the foam-forming amine oxides (available as the NINOX® series from Stephan Chemical Co.).

Therefore, the liquid concentrates of the present invention will comprise about 5–35%, preferably about 10–20% sodium or potassium hydroxide; about 50–90%, preferably about 60–85% total water; about 0.5–15% of a water-soluble polyacrylic acid, polyacrylic acid salt or mixtures thereof, a source of active chlorine effective to provide about 1–10%, preferably about 2–5% available chlorine; and about 0.05–15%, preferably about 0.1–10% of low molecular weight aliphatic phosphonic acid containing at least two groups capable of forming anions, at least one and preferably about 1–4 of which is a phosphonic acid group. Preferably the available chlorine will be provided by incorporating about 2–5% sodium hypochlorite into the concentrate.

The present aqueous concentrates may be readily prepared by adding an aqueous solution of the alkali metal hydroxide to soft water held in a polyvinylchloride or rubber-lined mixing tank and agitated with a stainless steel impeller. The acrylic polymer and the phosphonic acid are then added, preferably as aqueous solutions, followed by the active chlorine source, such as a solution of a hypochlorite salt in water. After thorough mixing at ambient temperatures, the solution is passed through a screen and used to fill the appropriate containers, e.g. 1–50 gallon high density polyethylene bottles or lined drums.

When diluted with water to a concentration about 0.1–10%, preferably about 0.2–5%, the present concentrates yield wash solutions which are particularly well-suited for use in CIP (cleaned-in-place) equipment of the type employed throughout the food-processing industry.

Cleaning-in-place procedures involve the cleaning and sanitizing of storage and/or processing equipment and piping in its assembled condition by recirculation of the necessary rinse, detergent and sanitizing solution through the equipment under appropriate conditions of time, temperature, detergency, and mechanical action. Recirculation is a necessary condition for CIP cleaning. In many cases, the detergent wash solution that is recirculated for cleaning is used over and over throughout a day or more. This type of a system is called "re-use CIP cleaning." In re-use CIP cleaning, generally a large stainless steel tank, with a capacity of holding 200–500 gallons of solution, is used to prepare the diluted wash solution. This same solution can be used to clean several different processing tanks and lines. Preferably the diluted wash solution will be applied to the soiled equipment at an elevated temperature, e.g. at about 50°–75° C.

The present invention will be further described by reference to the following detailed examples.

EXAMPLES I–V

Table I summarizes the composition of five liquid concentrates which were prepared. In each case the listed ingredients were added to soft water in amounts appropriate to yield the final wt.-% of the active ingredient as set forth in Table I.

TABLE I

| | Cleaning Concentrates | | | | |
|---|---|---|---|---|---|
| | Example (Final Wt. % Active Ingredient) | | | | |
| Ingredient | I | II | III | IV | V |
| Sodium Hydroxide | 15.0 | 15.0 | 15.0 | 15.0 | 15.0 |
| Sodium Polyacrylate | 2.7 | 2.7 | 2.7 | 2.7 | 2.7 |
| 2-Phosphonobutane-1,2,4-tricarboxylic Acid (Bayhibit AM) | .3 | .8 | — | — | — |
| 1-Hydroxyethylidene-1,1-diphosphonic Acid (Dequest ® 2010) | — | — | .3 | .8 | — |
| Sodium Hypochlorite | 3.0 | 3.0 | 3.0 | 3.0 | 3.0 |
| Water | q.s. | q.s. | q.s. | q.s. | q.s. |

EXAMPLES VI–IX

Table II summarizes the composition of four additional concentrates which were prepared. In each case the listed ingredients were added to soft water in amounts appropriate to yield the final wt.--% of the active ingredient as set forth in Table II.

TABLE II

| | CLEANING CONCENTRATES | | | |
|---|---|---|---|---|
| | Example (Final Wt. % Active Ingredient) | | | |
| Ingredient | VI | VII | VIII | IX |
| Sodium Hydroxide | 15.0 | 15.0 | 15.0 | 15.0 |
| Sodium Polyacrylate | 2.7 | 2.7 | 2.7 | 2.7 |
| Amino [tri(methylene-phosphonic acid)] (Dequest ® 2000) | 0.3 | 0.8 | — | — |
| Ethylenediamine [tetra (methylene-phosphonic acid)] (Dequest ® 2041) | — | — | 0.3 | 0.8 |
| Sodium Hypochlorite | 3.0 | 3.0 | 3.0 | 3.0 |
| Water (soft) | q.s | q.s | q.s | q.s |

COMPARATIVE GREASE DISPERSION TESTS

Three liter portions of wash solutions were prepared by diluting each of the concentrates of Examples I–IX to a concentration of 0.3% with semi-hard water (15 grains of hardness per gallon). The wash solution was heated to 68°–70° C. in a 6.0 l beaker equipped with a recirculating pump and hot plate heating. A 12.7 cm×12.7 cm stainless steel 304 or 316 panel was immersed halfway into the solution to be tested. Half-and-half milk (15 ml) was added and the mixture recirculated for 30 minutes at 6.0 psi at 68°–70° C. The recirculation was stopped for 30 minutes, then another 5.0 ml of milk was added and recirculation commenced. After 4 on-off cycles were completed, the panel was removed from the solution, rinsed with water and greasiness evaluated visually, using the following criteria:

1=No film or greasy build-up (soil line at air-liquid interface)

2=Light film, some build-up

3=Heavy film and greasy build-up

Table III summarizes the results of these tests.

TABLE III

| Panel Degreasing Tests | |
|---|---|
| Formula of Ex. | Degree of Filming |
| I | 2 |
| II | 1 |
| III | 2 |
| IV | 1 |
| V | 3 |
| VI | 2 |
| VII | 1 |
| VIII | 2 |
| IX | 1 |

As demonstrated by Table III, wash solutions prepared by diluting concentrates comprising 0.8% of 2-phosphonobutane-1, 2,4-tricarboxylic acid; 1-hydroxyethylidene-1,1-diphosphoric acid; amino [tri(methylene-phosphonic acid)]; or ethylenediamine [tetra(methylene-phosphonic acid)] are capable of completely degreasing fouled metal surfaces. Concentrates comprising 0.3% of 2-phosphonobutane-1,2,4-tricarboxylic acid; 1-hydroxyethylidene-1,1-diphosphonic acid; amino [tri(methylene-phosphonic acid)]; or ethylenediamine [tetra(methylene-phosphonic acid)] also exhibit substantially improved grease dispersion power over the diluted concentrate formed without an organic phosphonic acid component. (Ex. V.)

The invention has been described with reference to various specific and preferred embodiments and techniques. However, it should be understood that many variations and modifications may be made while remaining within the spirit and scope of the invention.

I claim:

1. An aqueous alkaline cleaning concentrate effective to disperse and degrade fatty or oily soil comprising a solution of:

(a) about 15% sodium hydroxide;

(b) about 0.8% 2-phosphonobutane-1,2,4-tricarboxylic acid;

(c) about 2.7% sodium polyacrylate having a molecular weight ranging from about 1000 to 6000;

(d) about 3.0% sodium hypochlorite; and (e) the balance comprising water wherein said concentrate is free of inorganic condensed phosphate salts.

2. A clean-in-place wash solution formed by diluting an aqueous alkaline cleaning concentrate effective to disperse and degrade fatty or oily soil, the concentrate comprising:

(a) about 15% sodium hydroxide;

(b) about 2.7% sodium polyacrylate having a molecular weight ranging from about 1000 to 6000;

(c) about 0.8% of 2-phosphonobutane-1,2,4-tricarboxylic acid;

(d) about 3.0% sodium hypochlorite; and (e) the balance water wherein said concentrate is free of inorganic condensed phosphate salts and is diluted to about 0.1% to 10% to form said wash solution.

3. A process for cleaning food processing, storage and preparation equipment fouled with fatty or oily soil comprising:

(a) dissolving about 0.1–10 parts by weight of a liquid cleaning concentrate and about 100 parts by weight of water to form an aqueous solution, said concentrate comprising:

(i) about 15% sodium hydroxide;

(ii) about 2.7% sodium polyacrylate having a molecular weight ranging from about 1000 to 6000;

(iii) about 0.8% of 2-phosphonobutane-1,2,4-tricarboxylic acid;

(iv) about 3.0% sodium hypochlorite; and (v) the balance being water, wherein said wash solution is free of inorganic condensed phosphate salts; and (b) contacting said aqueous solution with the fouled article in a recirculating clean-in-place system for a period of time effective to disperse said fatty or oily soil.

* * * * *